US006527308B2

(12) United States Patent
Linares

(10) Patent No.: US 6,527,308 B2
(45) Date of Patent: Mar. 4, 2003

(54) SPRING-LOADED CAMLOCK

(75) Inventor: Rodolfo A. Linares, Whittier, CA (US)

(73) Assignee: S.P.E.P. Acquisitions Corp, Carson, CA (US)

( * ) Notice: Subject to any disclaimer, the term of this patent is extended or adjusted under 35 U.S.C. 154(b) by 0 days.

(21) Appl. No.: 10/046,370

(22) Filed: Nov. 1, 2001

(65) Prior Publication Data

US 2002/0060456 A1 May 23, 2002

Related U.S. Application Data

(60) Provisional application No. 60/245,079, filed on Nov. 1, 2000.

(51) Int. Cl.[7] ..... E05C 19/10
(52) U.S. Cl. ..... 292/103; 292/242
(58) Field of Search ..... 292/242, 103, 292/DIG. 61; 70/379 R, 423

(56) References Cited

U.S. PATENT DOCUMENTS 1,692,295 A * 11/1928 Gerard
3,270,151 A * 8/1966 Godette ..... 200/44
3,705,508 A * 12/1972 Fritsch ..... 70/373
4,660,872 A * 4/1987 Carson ..... 292/242
4,759,204 A * 7/1988 Neyret ..... 70/360
5,265,453 A * 11/1993 Konii ..... 70/379
5,577,409 A * 11/1996 Oyabu ..... 70/379 R
5,640,864 A * 6/1997 Miyamoto ..... 70/379 R

* cited by examiner

*Primary Examiner*—Gary Estremsky
(74) *Attorney, Agent, or Firm*—Cislo &Thomas LLP

(57) ABSTRACT

A rotation camlock assembly having a spring, a first body rotatably mounted within a second body, and a cam or pawl mounted to said first body. The first body being a plug member that rotates with respect to the second body, the rotation being regulated by a spring mechanism in combination with a rotation limiting stop washer. The second body being a latch housing mounted to either a door or a stop structure associated with a door for the closure and latching of said door. The cam or pawl member rotates between a first position in which the latch assembly is disengaged and a second position in which the latch assembly is engaged, locking the door to a catch feature on the frame. The spring causes constant bias of the plug member and cam in the direction of engagement and a placed wholly between the first and second bodies.

15 Claims, 4 Drawing Sheets

SPRING-LOADED CAMLOCK

CROSS-REFERENCE TO RELATED APPLICATIONS

Pursuant to 35 U.S.C. §119(e), this application claims the benefit of U.S. Provisional Patent Application No. 60/245,079 filed on Nov. 1, 2000.

BACKGROUND OF THE INVENTION

This invention relates to camlocks, and more particularly to spring-loaded camlocks or latch assemblies and other rotatable latch closure mechanisms.

Rotation camlocks or latches are well known in the art. Typically, such a rotation latch has a housing that can be mounted to a door and containing a central bore. A plug is rotatably mounted in the bore of the latch housing and capable of rotating a cam or pawl between a locked and unlocked position. Rotation of the plug between the locked and unlocked positions is accomplished by an operator either by turning a handle on the top side of the plug or by inserting a properly shaped tool into the top side of the plug and turning the tool.

The camlocks on the market, however, require the operator to rotate the plug into the locked position as well as out of the locked position and into the unlocked position. This is inconvenient in most applications and is not adequate in certain applications, especially where a rotation requires a separate tool inserted into the top side of the plug.

Therefore, when closing a door having a standard camlock, the plug must be initially in the unlocked position and then manually rotated from the unlocked position to the locked position once the cam has cleared the strike plate or other structure designed to cause closure with the cam. This is a somewhat inconvenient operation even for a camlock equipped with a handle.

Many applications, however, require or benefit from a camlock that does not have a handle. A camlock may be designed to have a very low profile or even designed to be flush with the surrounding door surface. Such a low profile or flush camlock normally comes with a plug that has a particularly shaped depression on its otherwise flush surface. The depression is shaped to match a turning tool. As a result, the flush camlock is fully operational only with a turning tool. This makes the above-described steps for closing and locking the door particularly inconvenient. Additionally, where a door must be returned to the closed and locked position at all times, such as for safety or security reasons, this procedure of having to reach for the turning tool to close and lock the door is in fact inadequate.

What is needed is a camlock that is biased to the locked position such that a door having such a camlock may be closed and locked in a single motion without having to manually rotate the plug. The problem, however, is that typical camlocks leave no room for a biasing spring, especially in applications that prefer and utilize a low profile camlock.

Typically, the diameter of the bore in the housing and the diameter of the plug are sized to result in little, if any, play. The bore surface is typically coated with a grease to provide a slick surface within which the plug smoothly rotates. Thus, there is no room for a biasing mechanism in the typical camlock.

BRIEF SUMMARY OF THE INVENTION

This invention involves a rotation camlock assembly having a spring, a first body rotatably mounted within a second body, and a cam or pawl mounted to said first body. The first body is a plug or actuator that rotates with respect to the second body, the rotation being regulated by a spring mechanism in combination with a rotation limiting member. The rotation limiting member limits rotation to a 90° turn in the one embodiment; however, other ranges of motion are contemplated by this invention. The second body or latch housing is mounted to either a door or a stop structure associated with a door for the closure and latching of said door. The cam or pawl member rotates between a first position in which the latch assembly is disengaged and a second position in which the latch assembly is engaged, locking the door to the stop structure.

The top surface of the plug is equipped with either a handle or specifically shaped depression so that the plug may be rotated between the latched and unlatched positions. The spring is assembled in the camlock with a pre-set tension causing the plug and cam to be biased to the locked position. The amount of tension in the spring is sufficient to cause the plug and cam to return to the locked position at all times when a force is not applied to them, but not too strong, however, such that it would prevent rotation of the plug and cam by either a force applied to the top side of the plug or by an appropriate force applied to the cam.

As a result, in operation a locked door having a camlock of the present invention may be unlocked by turning the handle or by inserting and turning a tool having the necessary shaped end piece to fit the depression on the top surface of the plug. When the operator's hand or the tool is removed from the handle or plug, the spring we cause the plug to return to the locked position. In order to close and lock the door, however, all that is needed is to handle or plug, the spring we cause the plug to return to the locked position. In order to close and lock the door, however, the operator need only push the door shut. The cam and strike plate are shaped and positioned such that when the cam comes in contact with the strike plate, the force exerted on the cam causes the cam to rotate from the locked position enough for the cam to clear the strike plate. Once the cam has cleared the strike plate, the spring forces the cam to rotate back to the locked position. The camlock thereby locks the door closed as the result of the single motion of pushing the door closed. The camlock remains locked closed until an operator manually rotates the plug and opens the door as described above.

The entire latch assembly is small enough to fit in a standard half-inch bore in the door. The outer surface of the latch housing has two or more flattened sides to match the flattened surfaces of the bore so that the latch housing does not rotate relative to the door. The top surface of the latch housing and plug have a very low profile, nearly flush with the top surface of the door. Thus, the entire latch mechanism is housed substantially in the bore in the door, although the cam extends beyond the bottom surface of the door and, depending on the width of the door and the positioning of the strike plate, the latch may also extend somewhat beyond the bottom surface of the door.

An object of the present invention is to provide a rotation latch or camlock that is flush or near flush with the surface of the surrounding door.

Another object of the present invention is to provide a latch assembly that causes the cam of the camlock to be biased in the locked position such that manual operation of the latch is necessary only in the unlocking direction.

A further object is to provide a camlock that requires no manual turning of a handle or other turning device in order to close and lock a door.

Other aspects and advantages of the present invention will become readily apparent to those skilled in the art from the following detailed descriptions of preferred embodiments when considered in conjunction with accompanying drawings, which illustrate, by way of example, the principles of the invention.

DETAILED DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
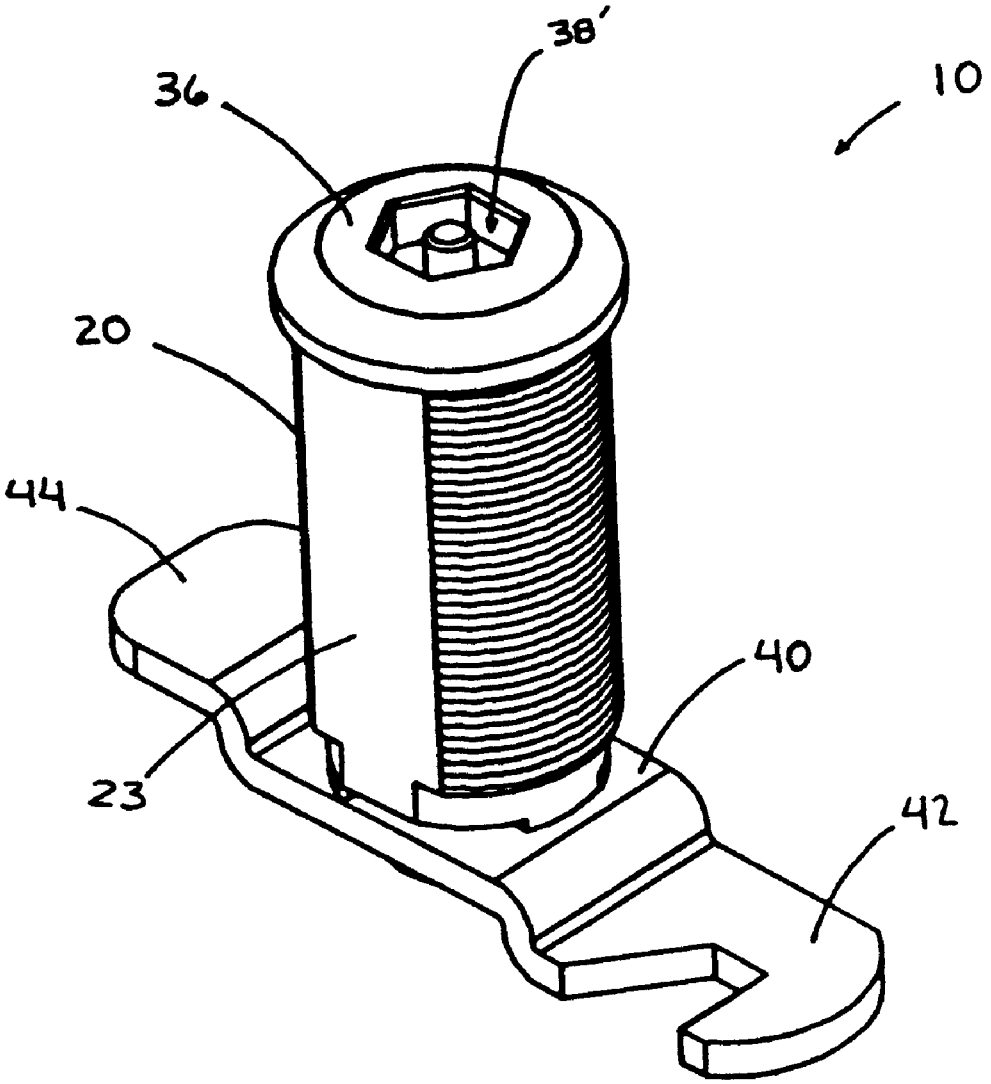
FIG. 1 is a perspective view of one embodiment of the present invention.
Figure 2:
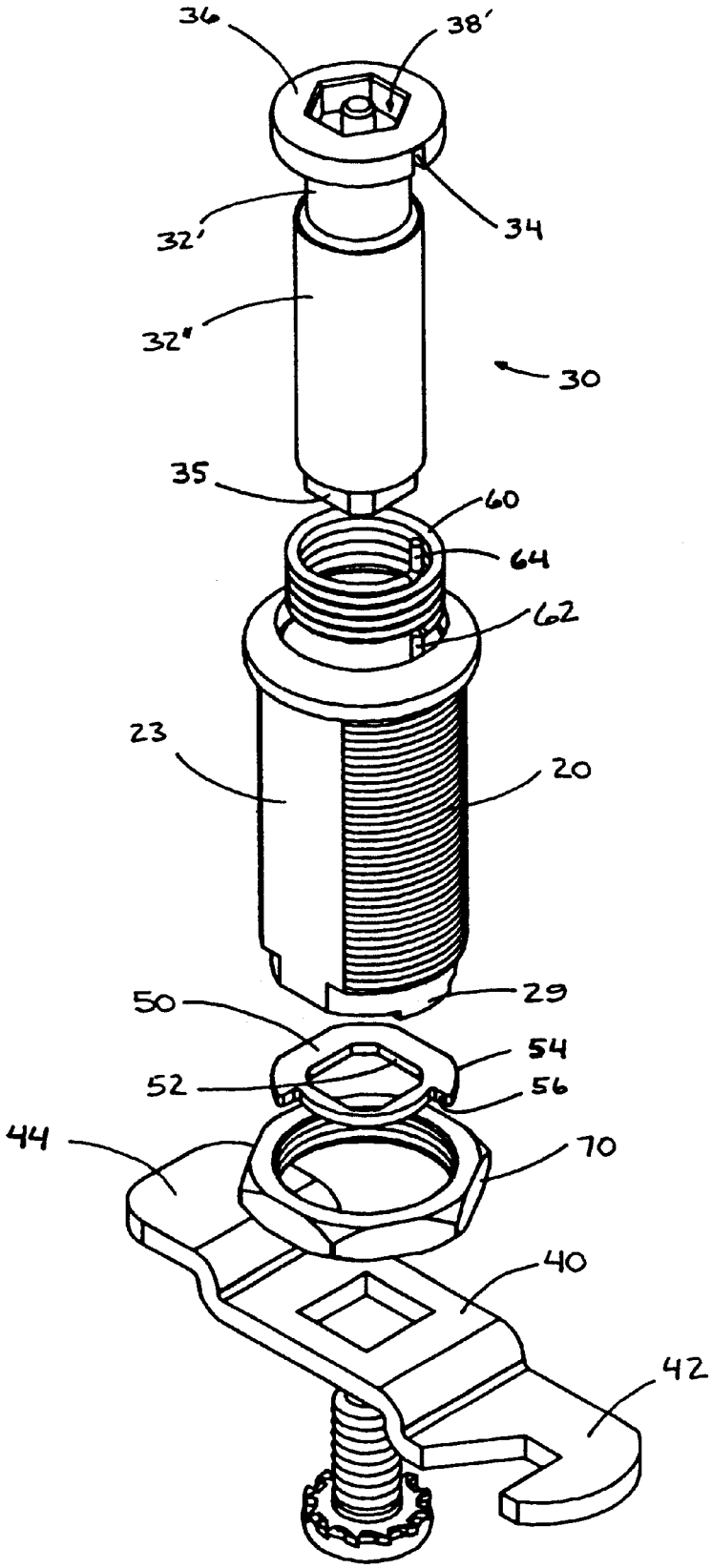
FIG. 2 is an exploded view of one embodiment of the present invention.

Referring now to the drawings, FIGS. 1 and 2 show one embodiment of the present invention. In particular, the camlock 10 comprises a latch housing 20 that houses a plug member or actuator 30. The outer surface 22 of latch housing 20 is generally cylindrical with two flattened sides 23 to fit through a similarly shaped hole in a door or frame (not shown) so that the latch housing will not rotate relative to the door or frame. The outer surface 22 of the latch housing 20 is threaded so that a nut 70 may be used to fix the latch housing 20 to the door or frame.

Plug 30 is rotatably mounted in the latch housing 20, and has a top surface 36 that is accessible from the outside of the door or frame. The top surface 36 of plug 30 is either fit with a suitable handle 38" or is fashioned to receive a suitable tool for rotating the plug 30. In FIG. 2, the top surface of plug 30 is provided with a depression 38' in the shape of a hexagon, but any other number of other shapes would work equally as well so long as a turning tool is designed with a similarly shaped end to be inserted into the depression 38' and thereby provide a means for turning the plug 30. Alternatively, the top surface 36 of plug 30 could be formed into a handle 38" so that an operator could turn the plug 30 without resorting to a separate turning tool. These and other similar methods for imparting an angular force on the plug 30 are contemplated by the present invention as would be obvious to one of skill in the art of such latches.

On the opposite end of the plug 30 is an actuator surface 35 shaped to exert an angular force on latch pawl 40. Latch pawl 40 is designed to rotate around a strike plate on the frame and to latch onto a catch feature on the back of the frame. In the preferred embodiment shown in FIG. 5, the pawl 40 can rotate 90°. Other ranges of rotation are equally contemplated. The important aspect of the range of rotation of the pawl 40 is that is can be rotated enough to clear the catch feature on the back of the frame. Secondarily, it may be desirable in certain applications for the pawl 40 to be able to rotate enough to clear the strike plate of the frame so that the door may be opened to either side of the frame. The pawl 40 in FIG. 2 further comprises an engagement end 42 and a locking end 44. The engagement end 42 is shaped to engage a catch feature of the strike plate or frame. The locking end 44 is shaped to engage one or more locking structures away from the catch feature. That is, while the engagement end 42 of pawl 40 may engage with a catch feature of the frame, the locking end 44 of the pawl 40 may engage with a slot in the door and causing the door and latch to lock in place. Alternatively, locking end 44 may be fashioned with a hole for receiving a pad lock for locking the door and latch.

Stop washer 50 is mounted to the actuator surface 35 of plug 30. The inner surface 52 of stop washer 50 is shaped to fit around or onto the actuator surface 35. The outer surface 54 of stop washer 50 has a camming surface 56 so that, when the stop washer 50 is rotated, camming surface 56 encounters a stop feature 29 on latch housing 20. As a result, stop washer 50 limits the motion of plug 30 and allows plug 30 to rotate only within a preset range.

Figure 3:
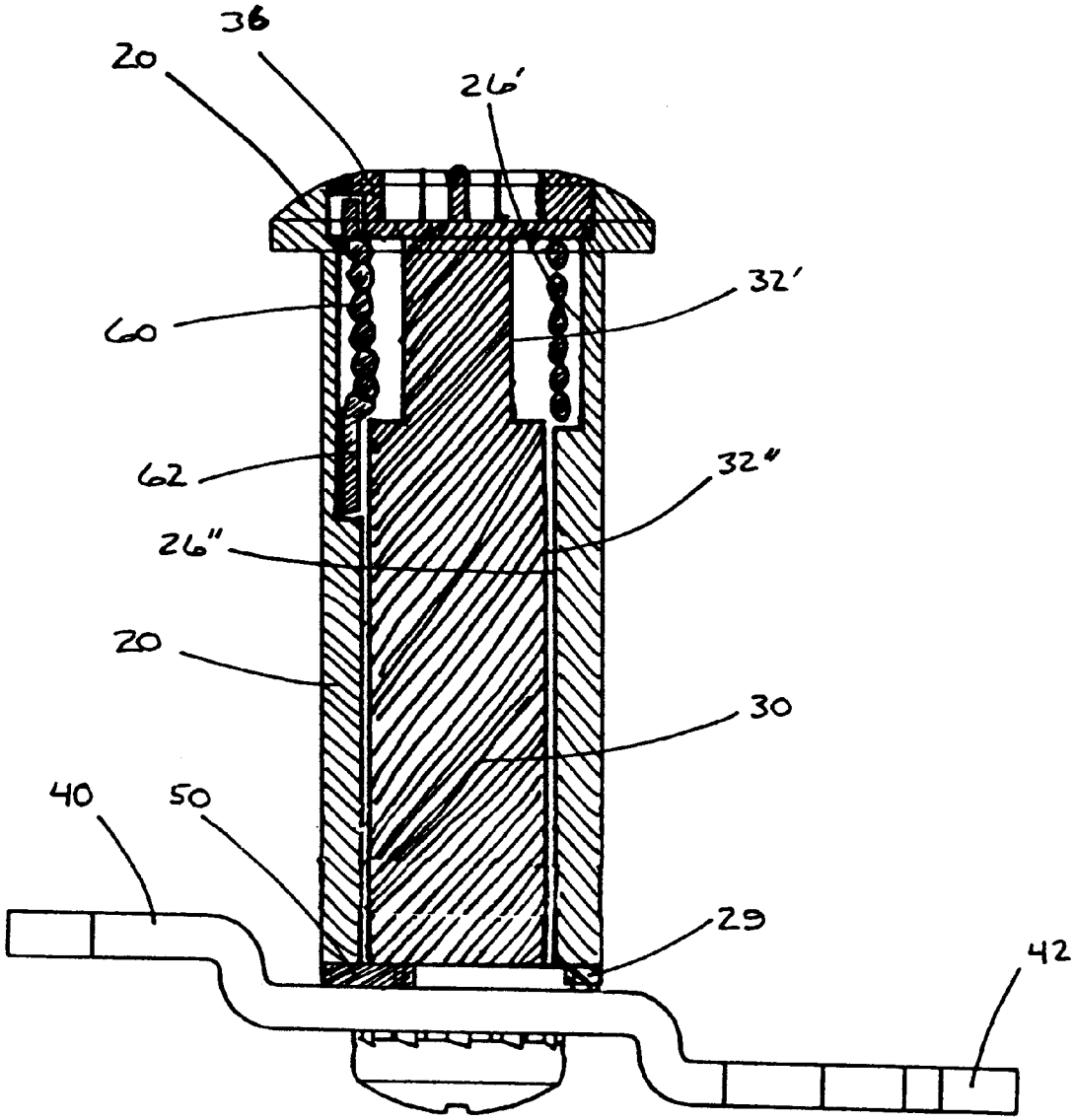
FIG.3 is a cross-section view of one embodiment of the present invention taken along the line III—III in FIG. 5.
Figure 4:
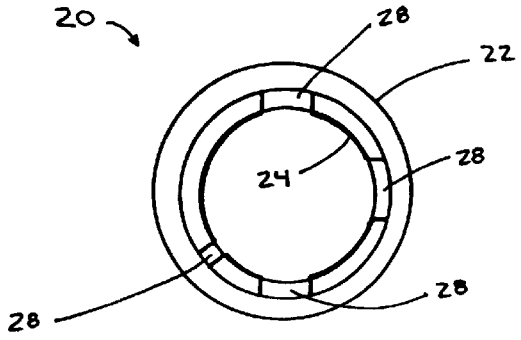
FIG. 4 is a top plan view of a latch housing according to the present invention.
Figure 5:
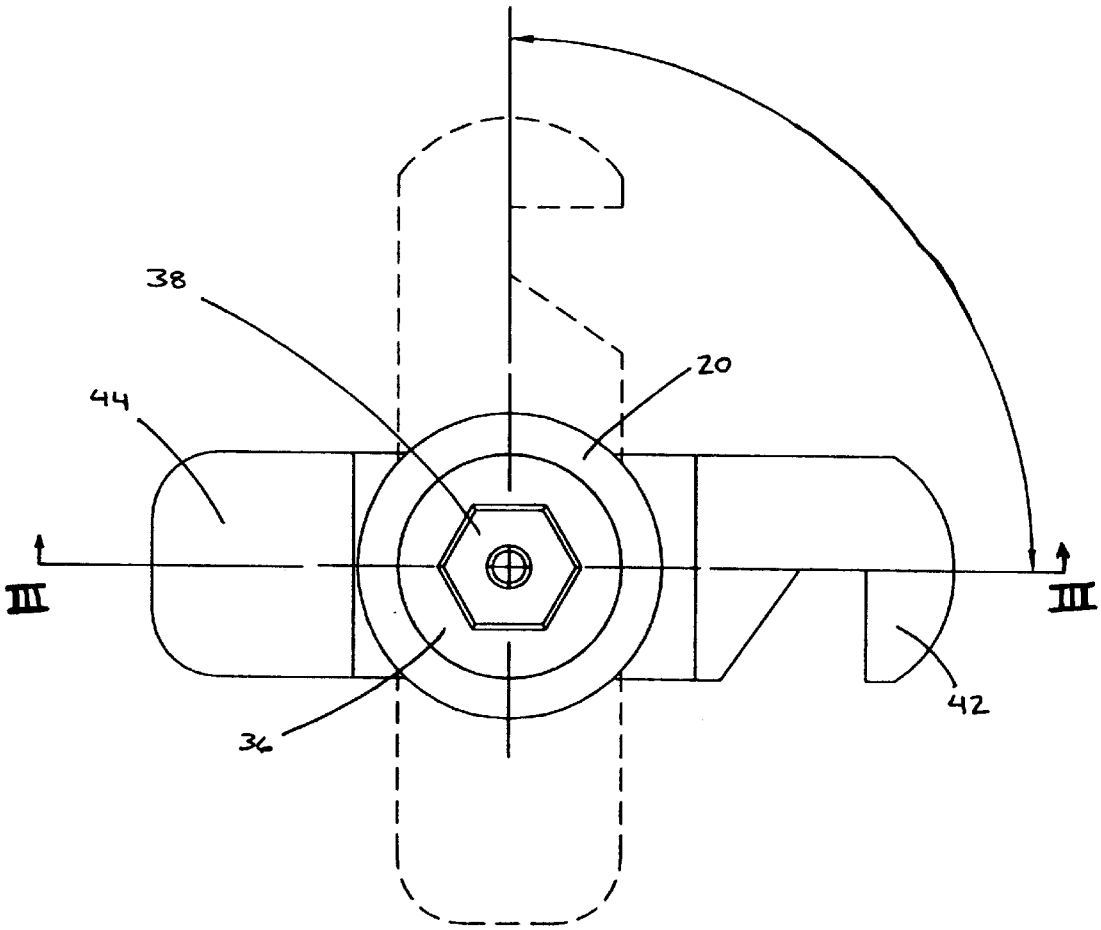
FIG. 5 is a top plan view of one embodiment of the present invention showing one range of rotation of the pawl or cam.

As shown in FIG. 2, a spring 60 is positioned intermediate the latch housing 20 and plug 30. FIGS. 2 and 3 illustrate that a first 64 end of the spring 60 is mounted into a recess or groove 34 in plug 30. A second end 62 of the spring 60 is mounted into a recess or groove 28 in latch housing 20, shown in FIGS. 3 and 4. Accordingly, spring 60 biases plug 30 in the latched direction relative to latch housing 20. In FIGS. 4 and 5, the latched direction is shown as the clockwise direction, while the unlatched direction is shown in the counter-clockwise direction. The spring 60 shown in FIGS. 2 and 3 is a torsion spring, but other biasing means are equally contemplated by the invention, including a coil spring, leaf spring, or lever or band configuration.

As shown in FIGS. 2 and 3, the diameter 32' of the generally cylindrical plug 30 adjacent to the spring 60 is reduced so as to provide room for the spring 60 as well as to provide room for the contraction of the diameter of the spring 60 during operation. At other places along the length of plug 60 the diameter 32" of plug 60 is greater so as to fit closely inside the inner wall 24 of the latch housing 20. Likewise, the diameter 26' of the inner surface of the latch housing 20 is greater adjacent to the spring 60 so that there is room for the spring 60. Elsewhere along the length of the latch housing 20, the diameter 26" of the inner wall 24 is smaller in order to closely contain the plug 30. A small amount of grease may be provided between these closely fitting surfaces to ensure smooth rotation of the plug 30 while also ensuring that there is very little play between the latch housing 20 and plug 30.

In FIG. 2, the spring 60 has five turns, whereas in FIG. 3, the spring is shown having six turns. Any number of other turns or fewer the number of turns may be used. It will be understood, however, that the fewer the number of turns, the greater will be the change in diameter of the torsion spring 60 when plug 30 is rotated either 90° or 180°. When stop washer 50 is designed for a 90° range of motion, plug 30 will rotate up to 90° and torsion spring 60 will extend up to a quarter turn when in use. A quarter turn will reduce the diameter of a five-turn torsion spring by about 1%; whereas a quarter turn will reduce the diameter of a six-turn torsion spring by about two-thirds of 1%. Consequently, the fewer the number of turns in the torsion spring 60, the greater will be the clearance necessary in the diameter 32' of the plug 30 adjacent to the torsion spring. A torsion spring that has a greater number of turns will deform less, but may be longer.

A torsion spring that has a fewer number of turns will deform more, but also may be shorter, taking up less of the length of plug 30. The present invention contemplates torsion springs of any number of turns as a trade off between length of spring 60 and the amount of deformation of spring 60 during use. The present invention also contemplates other biasing methods such as using other types of springs and durable elastic materials.

Spring 60 is designed to exert enough angular force on the plug of actuator 30 to bias it in the latched direction at every point in its range of rotation. The force of the spring 60, however, is readily overcome by the handle or turning tool as described above. The force is also readily overcome by the force exerted on the engagement end 42 of pawl 40 by the catch feature of the frame. That is, upon closing the door onto the frame, the pawl's engagement end 42 comes in contact with the catch feature of the frame and is thereby moved temporarily in the counterclockwise direction. When the engagement end 42 clears the catch feature, the spring 60 urges the actuator 30 and pawl 40 back to the closed direction, thereby latching the door closed. Thus, due to the proper strength of spring 60, the door may be closed and latched all in a single motion without having to manually insert a turning tool into the top surface 36 of the plug or actuator 30.

While the present invention has been described with regards to particular embodiments, it is recognized that additional variations of the present invention may be devised without departing from the inventive concept.

What is claimed is:

1. A latch assembly comprising:

a generally cylindrical latch housing having an outer and an inner wall, said inner wall defining a generally cylindrical bore through at least a portion of said latch housing, a generally cylindrical plug member rotatably mounted in said bore of said latch housing and having a range of rotation relative to the latch housing and a means for receiving an angular force during operation, a pawl mounted to said plug member, a stop washer having a cammed surface for restricting the range of rotation of the plug member, a spring connected to said plug member for biasing the plug member to one extreme of said range of rotation wherein said spring is at least partially contained.within the bore of said latch housing and wherein the diameter of the plug member is smaller adjacent to the spring to allow room for the spring to change shape during operation and wherein the diameter of the plug member is larger elsewhere to minimize any play between the plug member and the inner wall of the latch housing, and wherein said plug member further comprises one or more recesses, one of which is adapted to receive a second end of said spring.

2. A latch assembly according to claim 1 wherein said inner wall further comprises one or more recesses, one of which is adapted to receive a first end of said spring.

3. A latch assembly according to claim 1 wherein said stop washer limits the range of rotation of the plug to about 90°.

4. A latch assembly according to claim 1, wherein said one or more recesses and said stop washer are oriented to insure that the spring must be stretched upon assembly so that said spring exerts a force on the plug member at every position in the range of rotation.

5. A latch assembly according to claim 1, wherein said means for receiving an angular force on said plug member is a handle.

6. A latch assembly according to claim 1, wherein said means for receiving an angular force on said plug member is a depression on a portion of the plug member shaped to receive a portion of a torque imparting tool.

7. A latch assembly comprising:

a generally cylindrical latch housing having an outer and an inner wall, said inner wall defining a generally cylindrical bore through at least a portion of said latch housing, a generally cylindrical actuator rotatably mounted in said bore of said latch housing and having a range of rotation relative to the latch housing, a pawl mounted to said actuator, a means for limiting the range of rotation of said actuator relative to said latch housing, and a means for biasing the actuator to one extreme of said range of rotation, wherein said biasing means is a spring at least partially contained within the bore of said latch housing and wherein the diameter of the actuator is smaller adjacent to the spring to allow room for the spring to change shape during operation and wherein the diameter of the actuator is larger elsewhere to minimize any play between the actuator and the inner wall of the latch housing, and wherein said actuator further comprises one or more recesses, one of which is adapted to receive a second end of said spring.

8. A latch assembly according to claim 7 wherein said inner wall further comprises one or more recesses, one of which is adapted to receive a first end of said spring.

9. A latch assembly according to claim 7, wherein said means for limiting the range of rotation of the actuator limits the range to about 90°.

10. A latch assembly according to claim 7, wherein said biasing means is stretched upon assembly so that it exerts a force on the actuator at every position in the range of rotation.

11. A latch mechanism comprising:

a generally cylindrical actuator having a range of rotation, a pawl mounted to said actuator, a motion limiting means mounted to said actuator for restricting the range of rotation of said actuator, a spring connected to said actuator for biasing the actuator to one extreme of said range of motion, and at least one recess in said actuator for receiving one end of said spring, wherein said spring wraps around part of said actuator and wherein the diameter of the actuator is smaller adjacent to the spring to allow room for the spring to change shape during operation and wherein the diameter of the plug is larger elsewhere.

12. A latch mechanism according to claim 11 further comprising an outer wall on said housing having one or more flattened sides.

13. A latch assembly according to claim 11, further comprising a means connected to said actuator for receiving an angular force on said actuator.

14. A latch assembly according to claim 13, wherein said means for receiving an angular force on said actuator is a handle.

15. A latch assembly according to claim 13, wherein said means for receiving an angular force on said actuator is a depression on a top surface of said actuator shaped to receive a portion of a torque imparting tool.

* * * * *